US006297689B1

(12) United States Patent
Merrill

(10) Patent No.: US 6,297,689 B1
(45) Date of Patent: Oct. 2, 2001

(54) LOW TEMPERATURE COEFFICIENT LOW POWER PROGRAMMABLE CMOS VOLTAGE REFERENCE

(75) Inventor: Richard Billings Merrill, Woodside, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 0 days.

(21) Appl. No.: 09/243,841

(22) Filed: Feb. 3, 1999

(51) Int. Cl.[7] ..... G05F 1/10
(52) U.S. Cl. ..... 327/540
(58) Field of Search ..... 327/530, 538, 327/540, 545, 544, 77, 78, 83, 89, 52, 54, 87; 365/185.28

(56) References Cited

U.S. PATENT DOCUMENTS 5,546,042 * 8/1996 Tedrow et al. ..... 327/541
5,812,021 * 9/1998 Ikeda ..... 327/541
5,914,894 * 6/1999 Diorio et al. ..... 365/185.28
5,936,455 * 8/1999 Kobayashi et al. ..... 327/541
5,942,936 * 8/1999 Ricco et al. ..... 365/185.28

OTHER PUBLICATIONS

Seji Yamada, et al., "Non–uniform Current Flow through Tin Oxide After Fowler–Nordheim Current Stress", IEEE (May 1996).
Akinobu Teramoto, et al., "Excess Currents Induced by Hot–Hole Injection and F–N Stress in Thin $Sio_2$ Films", IEEE (May 1996).

* cited by examiner

*Primary Examiner*—Jung Ho Kim
(74) *Attorney, Agent, or Firm*—Sierra Patent Group, Ltd.; Seong-Kun Oh

(57) ABSTRACT

Apparatus for storing voltage on an Erasable Programmable Read-Only Memory (EPROM) buffered through an input voltage follower circuit provides an architecturally simple and efficient low temperature coefficient, low power, programmable complementary metal oxide semiconductor voltage reference.

40 Claims, 2 Drawing Sheets

LOW TEMPERATURE COEFFICIENT LOW POWER PROGRAMMABLE CMOS VOLTAGE REFERENCE

BACKGROUND OF THE INVENTION

1. Field of the Invention

The present invention relates generally to voltage references. In particular, the present invention relates to low temperature coefficient low power programmable complementary metal oxide semiconductor (CMOS) voltage references with simple and efficient architecture.

2. Description of the Related Art

Historically, the design of voltage references entailed the use of circuits containing hundreds of transistors. Due to this, the complexity and costs involved in designing such voltage references can be significantly high. Bandgap voltage reference circuits are most commonly used in CMOS mixed signal circuits to provide for a stable voltage reference. A standard bandgap reference such as, for example, LM330 3-Terminal Positive Regulator from National Semiconductor Corporation, has a variation of approximately 0.2% in output voltage over a temperature range from room temperature to 80° C. Moreover, as voltage references, erasable programmable read-only memories (EPROMs) are designed to support leakage on the order of 1 volt over a ten (10) year lifetime.

However, the bandgap circuit has a number of shortcomings. Some of these shortcomings include large dc power consumption, the need for parasitic, and usually unsupported, pnp or npn transistors, and the need to match the base emitter voltage ($V_{BE}$) for these parasitic devices. Additionally, several design iterations are often necessary to get the bandgap circuit to operate due to lack of good models for the second order effects upon which the bandgap performance is based. Moreover, the stability of the bandgap references over time has been a reliability issue for some CMOS products, for example, in telecommunications devices.

SUMMARY OF THE INVENTION

In view of the foregoing, the present invention discloses a low temperature coefficient low power programmable CMOS voltage reference.

In particular, an apparatus including a voltage reference in accordance with one embodiment of the present invention includes a reference terminal; an output terminal; a first transistor having first and second terminals; a second transistor having first and second terminals, said second transistor first terminal coupled to said output terminal; a capacitance coupled between said first transistor first terminal and said reference terminal configured to store a predetermined reference signal; and a variable signal generator coupled to said second transistor first terminal configured to provide a variable signal and in accordance thereto provide an output signal to said output terminal; wherein said variable signal is configured to vary such that said output signal is substantially equal in magnitude to said predetermined reference signal.

An apparatus including a voltage reference in accordance with another embodiment of the present invention includes a reference terminal; a first transistor having first, second and third terminals; a second transistor having second and third terminals; a capacitance coupled between said first transistor first terminal and said reference terminal, said capacitance configured to store a reference signal; and a programming signal source coupled to said first and second transistor third terminals configured to provide a programming signal thereto, and in accordance therewith, generates said reference signal across said capacitance.

An apparatus including a voltage reference in accordance with yet another embodiment of the present invention includes a reference terminal; an output terminal; a first transistor having first, second and third terminals; a second transistor having first, second and third terminals, said second transistor first terminal coupled to said output terminal; a capacitance coupled between said first transistor first terminal and said reference terminal configured to store a reference signal; a programming signal source coupled to said first and second transistor third terminals configured to provide a programming signal thereto, and in accordance therewith, generating said reference signal across said capacitance; and a variable signal generator coupled to said second transistor first terminal configured to provide a variable signal and in accordance thereto provide an output signal to said output terminal; wherein said variable signal is configured to vary such that said output signal is substantially equal in magnitude to said reference signal.

Accordingly, the present invention provides an architecturally simple and efficient voltage reference. These and other features and advantages of the present invention will be understood upon consideration of the following detailed description of the invention and the accompanying drawings.

DESCRIPTION OF THE PREFERRED EMBODIMENT

Figure 1:
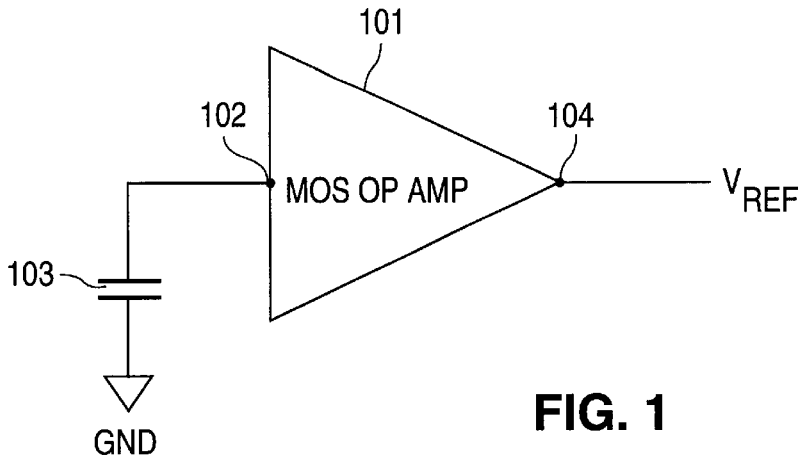
FIG. 1 shows a conceptual illustration of the voltage reference in accordance with one embodiment of the present invention.

FIG. 1 shows a conceptual illustration of the voltage reference in accordance with one embodiment of the present invention. As shown, there are provided a MOS input operational amplifier 101 having an input terminal 102 and an output terminal 104. Coupled to the input terminal 102 of the amplifier 101 is a reference capacitor 103 which is further coupled to a reference terminal such as a ground terminal GND. In this manner, a reference voltage $V_{REF}$ stored in the reference capacitor 103 is buffered by the MOS amplifier 101 and provided to the output terminal 104 of the amplifier 101. Since the reference capacitor 103 itself does not draw any current, in can be seen that the overall architecture requires less power to operate.

Figure 2:
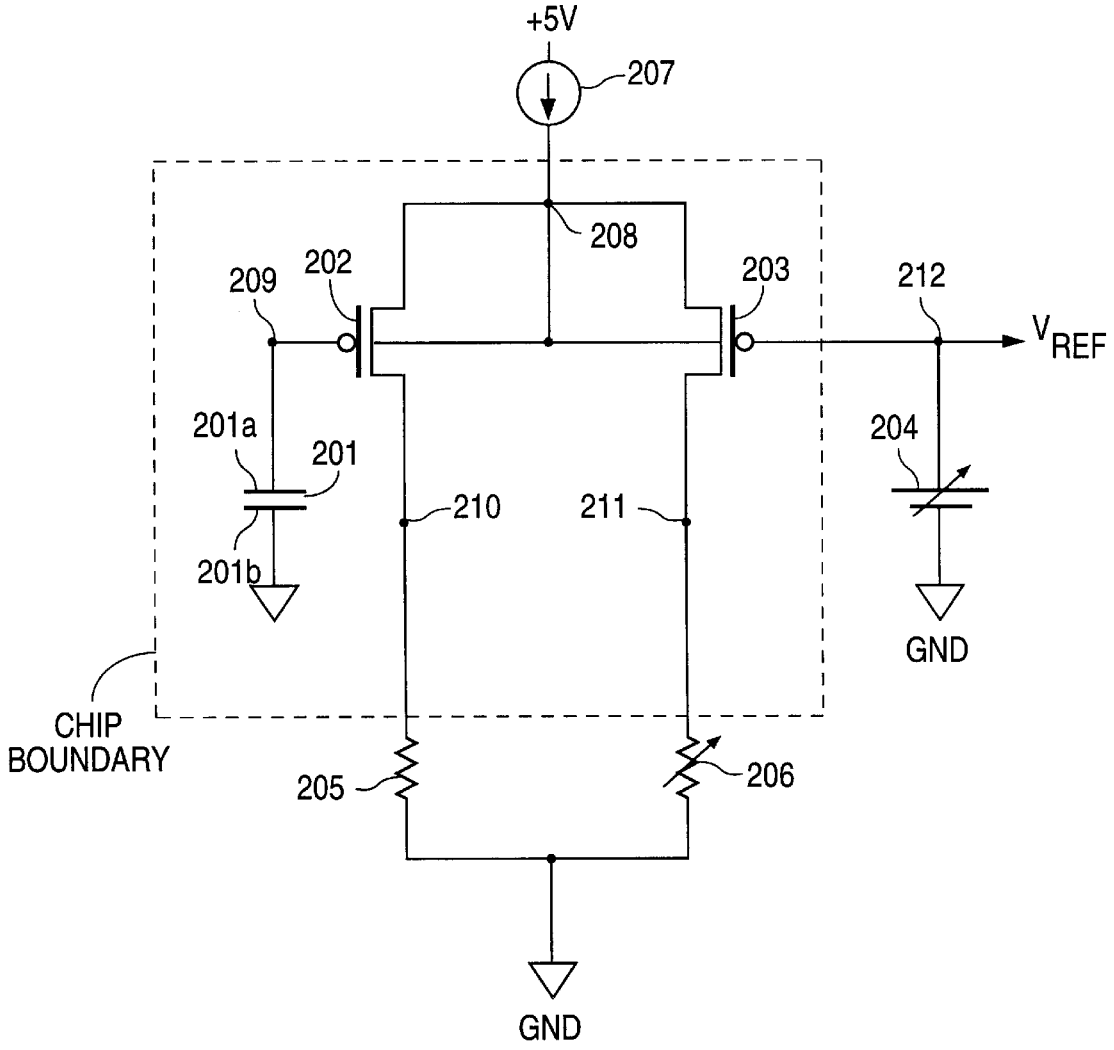
FIG. 2 illustrates the voltage reference circuit in accordance with one embodiment of the the present invention.

FIG. 2 illustrates a capacitive voltage reference in accordance with one embodiment of the present invention. As shown, there are provided two transistors 202, 203 in a differential amplifier configuration whose drain terminals are coupled at node 208. Also coupled to node 208 is a reference signal source 207 configured to provide a reference signal thereto. The gate terminal of transistor 202 is coupled to a reference capacitor 201 at node 209. The reference capacitor 201 is further coupled to a reference terminal which can be a ground terminal GND.

The gate terminal of transistor 203 is coupled to a variable voltage source 204 at node 212 to provide variable voltages thereto. The variable voltage source 204 coupled to node 212 can be variably adjusted as discussed in further detail below so that the voltages at the nodes 210 and 211 are matched. In this matched state, the differential amplifier (transistors 202 and 203) has substantially the same current at nodes 210 and 211 thereby providing a balanced differential amplifier. When the differential amplifier is balanced, node 212 is matched with node 209 such that any voltage variation at node 209 is reflected as voltage variation at node 212. Accordingly, the reference voltage pre-programmed in the reference capacitor 201 can be sampled at node 212 without substantially draining the stored voltage across the reference capacitor 201 and thereby avoiding potential leakage. In this manner, by measuring or sampling the voltage level at node 212, it is possible to determine the voltage level at node 209 representing the level of the voltage reference stored in the reference capacitor 201.

Referring to FIGS. 1 and 2, in accordance with one embodiment of the present invention, a programming signal can be directly applied to the gate dielectric of the transistor 203 to program the desired reference voltage for the voltage reference circuit. In particular, a voltage can be applied, for example, from the reference signal source 207 to node 208 to induce a current flow known as Fowler/Nordheim tunneling current across the source-gate barrier of transistor 202; i.e., between the source and gate terminals of transistor 202. The application of the voltage at node 208, in turn, varies the charge level on node 209 such that the top plate 201*a* of the reference capacitor 201 is more positively charged as compared to the bottom plate 201*b* of the reference capacitor 201, thereby programming a voltage at node 209 with respect to the reference terminal (such as the ground terminal GND) coupled to the bottom plate 201*b* of the reference capacitor 201. It is to be noted that the actual voltage level at node 209 depends largely upon the intended application for the voltage reference. Naturally, using the approach described above, the programmable voltage level can be modified as necessary.

It is also to be noted that programming of the initial reference voltage across the reference capacitor 201 to configure the voltage reference for use as a voltage reference as described above can also be achieved by lowering the voltage of the bottom plate 201*b* of the reference capacitor 201. In specific, a voltage across the gate dielectric of transistor 202 can be applied which will change the total amount of charge on node 209. In other words, if node 208 is made relatively negative with respect to node 209, electrons will be injected to node 209 to make node 209 relatively more negative, and conversely, if node 208 is made relatively positive with respect to node 209, electrons will be pulled out of node 209, thus rendering node 209 relatively more positive with respect to node 208. For example, approximately 10 Mvolts/cm will be required to induce current flow across the gate dielectric of transistor 202. In the case of a 100 angstrom oxide (of transistor 202), 10 volts will be required to pull current across the gate dielectric of transistor 202.

Further shown in FIG. 2 are resistor 205 and variable resistor 206 which are coupled to the corresponding source terminals of the transistor pair 202, 203 at nodes 210 and 211, respectively. During the initial programming stage of the voltage reference in accordance with one embodiment of the present invention, the variable resistor 206 coupled to the source terminal of transistor 203 at node 211 is variably adjusted off-chip at room temperature to match resistor 205 which is coupled to the source terminal of transistor 202 at node 210. Additionally, the variable voltage source 204 coupled to the gate terminal of transistor 203 at node 212 is likewise adjusted to minimize any offset between the two source terminals of transistors 202 and 203 such that the voltage at node 212 substantially equals the voltage at node 209 which couples the reference capacitor 201 to the gate terminal of transistor 202, and also, to minimize any offsets between the two transistors 202 and 203.

Then, the temperature of the chip is increased and the variable voltage source 204 is further adjusted to minimize offsets between the source terminals of the two transistors 202, 203 at nodes 210 and 211, respectively. Accordingly, the variation in the variable voltage source 204 applied to minimize offsets between the source terminals of the transistors 202, 203 coupled at nodes 210 and 211, respectively, in response to the temperature increase in the chip then corresponds to the sum of the temperature coefficient $T_C$ of the reference capacitor 201 and any component offsets between transistors 202 and 203 which has a dependence upon variations in temperature. For example, as the on-chip junction temperature changes, the temperature-dependent variations in the transistor pair 202, 203 will rise and fall together such that the signal at node 212 will track the signal at node 209 irrespective of the chip temperature.

Accordingly, by variably adjusting the voltage with the variable voltage source 204 at node 212, any variation in the on-chip temperature will have the same effect, if any, upon both transistors 202, 203 because the differential amplifier is in a substantially balanced condition. Moreover, the amount of charge loss across the reference capacitor 201 can be determined by comparing the initial temperature coefficient $T_C$ of the reference capacitor 201 with a subsequent measurement of the same after a predetermined exposure to a temperature of, for example, 250° C.

The reference voltage programming across reference capacitor 201 as described above, however, may disturb the symmetry of the differential amplifier. More specifically, because the programming operation is fairly stressful upon the gate dielectrics of transistors 202 and 203, this operation may cause a shift in the symmetry between the two transistors 202, 203. Thus, to regain symmetry between transistor 202 and transistor 203 of the differential amplifier, a dummy programming can be used.

For example, one approach to providing a dummy programming includes providing a same current to both transistors 202 and 203 to equilibrate them and then proceed with the programming of the transistor 202 as described above. The dummy programming is performed as the final test stage and can be used to program any analog voltage if a feedback is applied during programming. As discussed previously, the voltage at node 208 is initially raised to a predetermined level sufficient to provide a current through the gate dielectric of transistor 202 (the forcing function). Due to symmetry obtained between the two transistors 202 and 203, the raised voltage at node 208 provides the current to both transistors 202 and 203, and by measuring the voltage at node 212, the programming voltage can be determined. Accordingly, the shift in the transistors 202 and 203 remain relatively consistent with one another thereby preserving the symmetry therebetween.

For example, in the case of a 2-volt voltage reference with an initial voltage at node 209 of 1 volt (which can be determined by measuring the voltage at node 212), a voltage of 5 volts, for example, is applied by the reference signal source 207 at node 208 which is sufficient to provide a current through the gate dielectric of transistor 202. By measuring the voltage at node 212, the voltage increase in node 209 from the initial 1 volt, for example, to a higher level such as 1.5 volts, can determined. Since this measured value is still below the desired reference voltage of 2 volts, the same procedure as outlined above is repeated until the voltage at node 209 is raised to the desired voltage for the voltage reference, in this instance, 2 volts.

Thus, as can be seen, by increasing the voltage across the gate dielectric of transistor 202 until it conducts current, the long term threshold voltage $V_T$ offset drift of the matched transistor pair 202, 203 can be significantly improved. Moreover, in accordance with the present invention, the programming time would not pose a significant problem as is the case with EPROMs since there is only one capacitor to program, and since this programming step would take the place of trimming which would normally be applied to precision voltage references.

Figure 3:
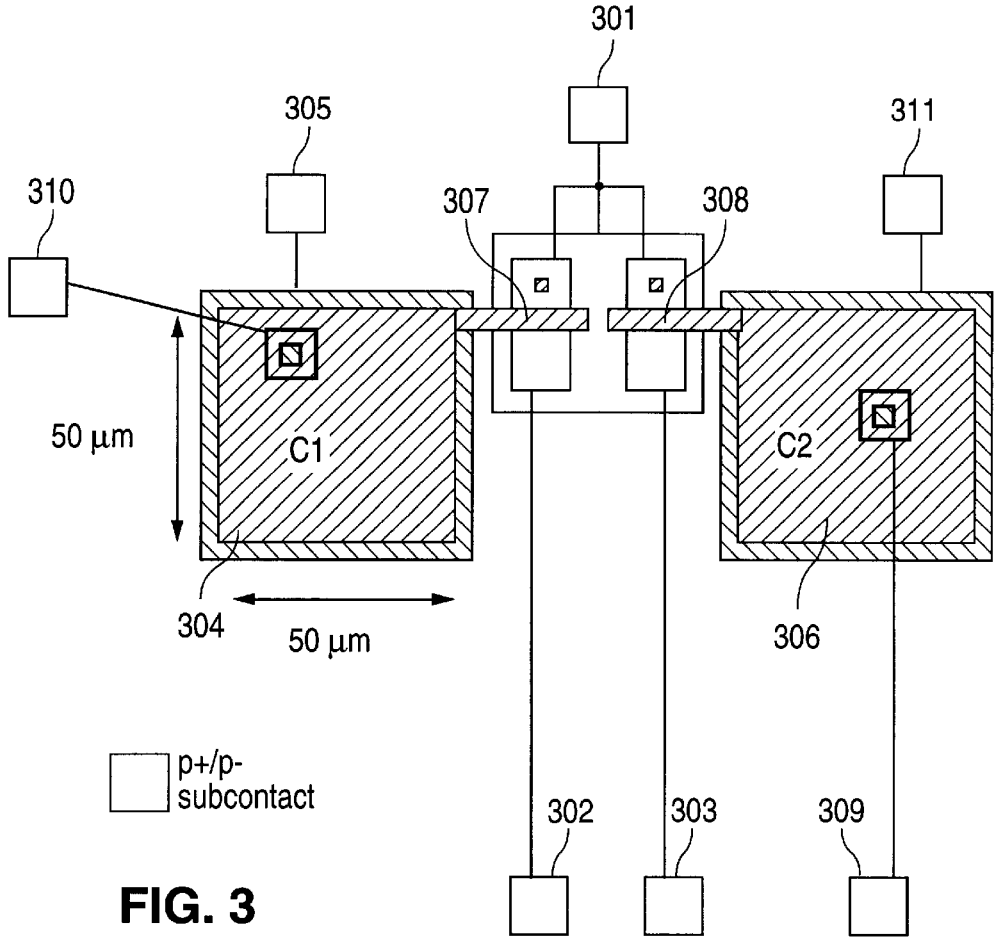
FIG. 3 illustrates an implementation layout of the voltage reference in accordance with one embodiment of the present invention.

FIG. 3 illustrates an implementation layout of the CMOS voltage reference circuit in accordance with one embodiment of the present invention. As shown, nodes 301, 302 and 303 correspond to nodes 208, 210, and 211, respectively, of the voltage reference circuit illustrated in FIG. 2. In particular, node 301 in FIG. 3 corresponds to the node at which the drain terminals of the two transistors 202, 203 (FIG. 2) are coupled, and also coupled thereto is the reference signal source 207 (FIG. 2). Further, nodes 302 and 303 respectively correspond nodes 210 and 211 of the embodiment shown in FIG. 2 where the source terminals of the transistor pair 202, 203 in the differential amplifier are respectively coupled.

Further shown in FIG. 3 is capacitor C1 which corresponds to the reference capacitor 201 of FIG. 2. The top plate 304 and the bottom plate 305 of the capacitor C1 correspond respectively to the top plate 201*a* and bottom plate 201*b* of the reference capacitor 201 of FIG. 2. The top plate 304 of the capacitor C1 includes a floating polysilicon layer in order to achieve minimal temperature coefficient $T_C$. Moreover, as can be seen, the top plate 304 of capacitor C1 is extended over the edge of the polysilicon layer to form first transistor 307 which corresponds to transistor 202 of the voltage reference as illustrated in FIG. 2. Thus, it can be seen that node 209 coupling the reference capacitor 201 to the gate terminal of transistor 202 in FIG. 2 corresponds to node 310 corresponding to the contact with the area on the top plate 304 as shown in FIG. 3.

Likewise, second transistor 308 corresponding to transistor 203 in the voltage reference circuit as shown in FIG. 2 is formed by extending the upper polysilicon layer of a second capacitor C2 as shown in FIG. 3. In this manner, the tracking gate at node 309 which is connected to the top plate 306 of the second capacitor C2 corresponds to node 212 of FIG. 2 which is coupled to the gate terminal of transistor 203 and the variable voltage source 204 (FIG. 2). Moreover, as can be seen, second transistor 308 is connected to the second capacitor C2 to maintain symmetry with first transistor 307 up to the contact mask. The connection to the second capacitor C2 further contributes to improving the matching of first and second transistors 307, 308. Additionally, a dummy bottom plate 311 is provided to the second capacitor C2 to further improve matching between transistors 307 and 308.

Furthermore, if a floating node such as node 310 is FIG. 3 is connected to any kind of metal interconnections, the retention capability of the floating node is drastically reduced primarily due to the fact that the metal interconnections generally protrude through the dielectric layers and thus are not as well protected by the passivation layers that are normally deposited. For example, after the second polysilicon layer is deposited, a layer containing high concentration of phosphorus is deposited such that the phosphorus minimizes any sodium ions contamination which may be introduced during the process steps. Metal interconnections coupled to the floating node 310 will protrude through the layer of high concentration phosphorus and become exposed to sodium ions. Therefore, using a double layer of polysilicon as shown in the present invention rather than a single polysilicon layer maximizes the retention time of the floating nodes where the floating nodes are coupled to transistors and the like via metal interconnections.

Moreover, in accordance with the present invention, the area of the floating polysilicon layer for both capacitors C1 and C2 which does not cover the corresponding lower polysilicon layer is kept to a minimum to preserve a good temperature coefficient $T_C$.

One issue with respect to the operating conditions of the voltage reference in accordance with the present invention is how well transistor 307 and transistor 308 are matched. This is significant since transistor 308 is essentially configured to replicate the operation of transistor 307, and thus, any offset in the matching of transistors 307 and 308 will offset the operability of the voltage reference circuit itself.

Figure 4:
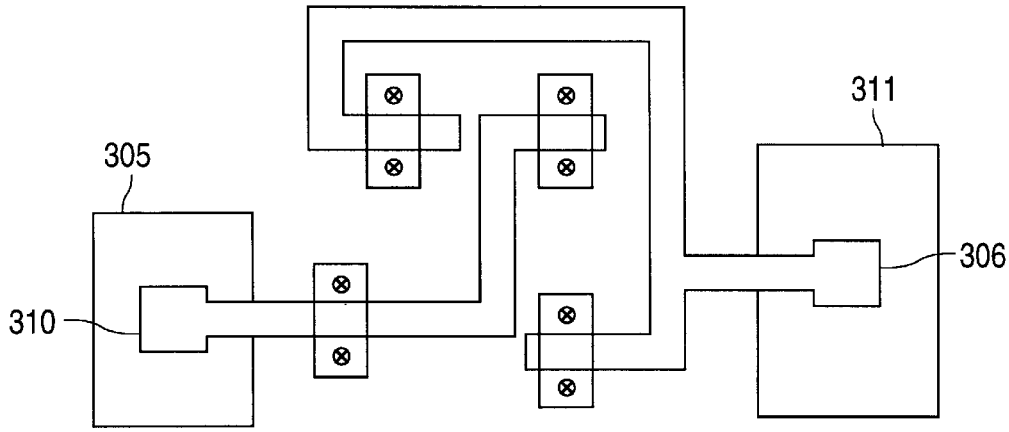
FIG. 4 illustrates a cross-coupled transistor implementation layout of the voltage reference in accordance with one embodiment of the present invention.

To provide improved matching of transistors 307 and 308, a cross coupled transistor in accordance with one embodiment of the present invention is provided as illustrated in FIG. 4. In particular, the first and second transistors 307, 308 of FIG. 3 (which corresponds to transistors 202, 203 comprising the differential amplifier as illustrated in FIG. 2) are provided in a cross coupled configuration in the implementation layout. It is to be noted that like elements shown in FIG. 4 which correspond to the counterpart elements in FIG. 3 are labelled as such. The implementation layout of transistors 307 and 308 of FIG. 3 is now provided in a cross-coupled manner as shown in FIG. 4 such that the gradient across the wafer cancels thus providing a more stable transistor mismatch over time.

Accordingly, the cross-coupled transistor embodiment as shown in FIG. 4 provides improved transistor matching, which results in improved offset drift over time, and therefore, the voltage reference circuit incorporating the cross-coupled transistor configuration will be more stable. On the other hand, such cross-coupled configuration would require more area of the floating polysilicon layer which is not situated over the lower polysilicon layer. Consequently, this cross-coupling transistor configuration may have potential adverse effect on the temperature coefficient $T_C$. Nevertheless, the cross-coupled transistor configuration shown in FIG. 4 provides a more stable reference voltage circuit.

As illustrated above, in accordance with the present invention, the reference voltage is stored over the reference capacitor with low leakage such as an EPROM capacitor, for example, a few millivolts over the product's life. The stored voltage on an EPROM capacitor is then buffered through a pMOS input voltage follower to provide a reference voltage with 8 ppm/° C.

Since a poly-to-poly capacitor has a temperature coefficient $T_C$ of 8 parts per million (ppm) over a temperature range of 60° C., the temperature-dependent variation of the reference capacitor would be 480 ppm or 0.05% over the temperature range. Thus, a reference voltage stored in such poly-to-poly capacitor would only change by 0.05% over the given temperature range of 60° C.

As compared with the temperature coefficient $T_C$ of bandgap references such as the LM330 3-Terminal Positive Regulator, the poly-to-poly capacitor has a temperature coefficient which is four times better. Furthermore, since the only transistor that the stored charge node in the reference capacitor is connected to is a pMOS transistor (instead of a nMOS transistor as is the case with EPROMs), there is a much lower probability of hole channel current passing through the gate oxide in the pMOS transistor than electron channel current in the NMOS transistor. Additionally, since the area of the reference capacitor in accordance with the present invention is many times that of an EPROM capacitor (in the order of picoFarads rather than femtoFarads) such that the area-to-perimeter ratio is much higher, the effects of perimeter-related leakage such as migration of ions are significantly reduced. Moreover, in accordance with the present invention, only one capacitor is conditioned to not leak, whereas EPROMs contain millions of cells which must all be operational. Therefore, some guard banding is built into the EPROM relaxation requirement of 1 volt drop in the 10 year lifetime period of a product. In others words, EPROMs must allow for worst case whereas the present invention can assume typical leakage.

Further, the voltage reference circuit according to the present invention need only be programmed once, not multiple times as is the case for most EPROMs. This is an advantage since multiple programming increases leakage in the gate dielectric through which the reference voltage programming is completed. Moreover, the voltage reference circuit shown in the present invention is also fully static during operation, thus eliminating many kinds of read disturb seen in EPROMs. Also, voltage across the source-gate and drain-gate oxide of the first transistor (transistor 202 in FIG. 2, for example) can be designed to be very low.

The electric field in the reference capacitor in accordance with the present invention is relatively low (approximately one volt) compared to several volts in EPROM. In turn, tunneling leakage decreases very rapidly with reduction in voltage. However, the voltage reference circuit of the present invention can operate with a low signal voltage because the capacitance is relatively large compared to an EPROM such that the signal which is proportional to the stored charge in the reference capacitor can be large even if the voltage is small. Also, since the area of the reference capacitor is not a constraint as in the case with the design of an EPROM cell, novel layout techniques may be used to improve leakage from the floating gate. For example, the guard bands around the voltage reference circuit may be used to provide a barrier for lateral charge migration.

As is known, EPROM floating gates are programmed negative with electron injection. Thus, sodium (Na) and other positive ions are attracted to the gate. This is one of the limiting mechanisms for EPROM lifetime. By contrast, the present invention allows the floating gate to be programmed positive which will repel ionic contamination. Finally, the voltage reference cell of the present invention allows for a very small active gate area compared to the capacitor area (e.g., 100:1). With most EPROMs, the ratio of the active gate area to storage capacitor areas is on the order of one to one (1:1).

Various other modifications and alterations in the structure and method of operation of this invention will be apparent to those skilled in the art without departing from the scope and spirit of the invention. Although the invention has been described in connection with specific preferred embodiments, it should be understood that the invention as claimed should not be unduly limited to such specific embodiments. It is intended that the following claims define the scope of the present invention and that structures and methods within the scope of these claims and their equivalents be covered thereby.

What is claimed is:

1. An apparatus including a voltage reference, comprising;

a reference terminal;

a first transistor having first, second and third terminals;

a second transistor having second and third terminals;

a capacitance coupled between said first transistor first terminal and said reference terminal, said capacitance configured to store a reference signal; and a programming signal source coupled to said first and second transistor third terminals configured to provide a programming signal thereto, and in accordance therewith, generates said reference signal across said capacitance;

wherein said capacitance is an EPROM capacitor having a substantially low leakage level.

2. The apparatus of claim 1 wherein said reference terminal is ground.

3. The apparatus of claim 1 wherein said programming signal source is a voltage generator.

4. The apparatus of claim 1 wherein said first transistor first terminal is a gate terminal, said first and second transistor second terminals are source terminals, and further, wherein said first and second transistor third terminals are drain terminals.

5. The apparatus of claim 1 wherein said first transistor is a pMOS transistor.

6. A method of providing a voltage reference, comprising the steps of:

providing a reference terminal;

providing a first transistor having first, second and third terminals;

providing a second transistor having second and third terminals;

coupling a capacitance between said first transistor first terminal and said reference terminal, said capacitance configured to store a reference signal; and couping a programing signal source to said first and second transistor third terminals configured to provide a programming signal thereto, and in accordance therewith, generating said reference signal across said capacitance;

wherein said capacitance is an EPROM capacitor having a substantially low leakage level.

7. The method of claim 6 wherein said reference terminal is ground.

8. The method of claim 6 wherein said programming signal source is a voltage generator.

9. The method of claim 6 wherein said first transistor first terminal is a gate terminal, said first and second transistor second terminals are source terminals, and further, wherein said first and second transistor third terminals are drain terminals.

10. The method of claim 6 wherein said first transistor is a MOS transistor.

11. An apparatus including a voltage reference, comprising:

a reference terminal;

an output terminal;

a first transistor having first, second and third terminals;

a second transistor having first, second and third terminals, said second transistor first terminal coupled to said output terminal;

a capacitance coupled between said first transistor first terminal and said reference terminal configured to store a reference signal;

a programming signal source coupled to said first and second transistor third terminals configured to provide a programming signal thereto, and in accordance therewith, generating said reference signal across said capacitance; and a variable signal generator coupled to said second transistor first terminal configured to provide a variable signal and in accordance thereto provide an output signal to said output terminal;

wherein said variable signal is configured to vary such that said output signal is substantially equal in magnitude to said reference signal; and further wherein said capacitance is an EPROM capacitor.

12. The apparatus of claim 11 further including:

a resistance coupled to said first transistor second terminal; and a variable resistance coupled to said second transistor second terminal configured to provide a resistance substantially equal to said resistance.

13. The apparatus of claim 12 wherein said first and second transistors are matched.

14. The apparatus of claim 11 wherein said first and second transistors first terminals are gate terminals, said first and second transistor second terminals are source terminals, and further, wherein said first and second transistor third terminals are drain terminals.

15. The apparatus of claim 11 wherein said first transistor is a pMOS transistor.

16. The apparatus of claim 11 wherein said variable signal generator is a variable voltage generator.

17. The apparatus of claim 11 wherein said reference terminal is ground.

18. A method of providing a voltage reference, comprising the steps of:

providing a reference terminal;

providing an output terminal;

providing a first transistor having first, second and third terminals;

providing a second transistor having first, second and third terminals, said second transistor first terminal coupled to said output terminal;

coupling a capacitance between said first transistor first terminal and said reference terminal configured to store a reference signal;

coupling a programming signal source to said first and second transistor third terminals configured to provide a programming signal thereto, and in accordance therewith, generating said reference signal across said capacitance; and coupling a variable signal generator to said second transistor first terminal configured to provide a variable signal and in accordance thereto providing an output signal to said output terminal;

wherein said variable signal is configured to vary such that said output signal is substantially equal in magnitude to said reference signal; and further wherein said capacitance is an EPROM capacitor.

19. The method of claim 18 further including the step of:

coupling a resistance to said first transistor second terminal; and coupling a variable resistance to said second transistor second terminal configured to provide a resistance substantially equal to said resistance.

20. The method of claim 19 wherein said first and second transistors are matched.

21. The method of claim 18 wherein said first and second transistors first terminals are gate terminals, said first and second transistor second terminals are source terminals, and further, wherein said first and second transistor third terminals are drain terminals.

22. The method of claim 18 wherein said first transistor is a pMOS transistor.

23. The method of claim 18 wherein said variable signal generator is a variable voltage generator.

24. The method of claim 18 wherein said reference terminal is ground.

25. An apparatus including a voltage reference, comprising:

a reference terminal;

an output terminal;

a first transistor having first and second terminals;

a second transistor having first and second terminals, said second transistor first terminal coupled to said output terminal and said second transistor second terminal coupled to said first transistor second terminal;

an EPROM capacitor coupled between said first transistor first terminal and said reference terminal configured to store a predetermined reference signal; and a variable signal generator coupled to said second transistor first terminal configured to provide a variable signal and in accordance thereto provide an output signal to said output terminal;

wherein said variable signal is configured to vary such that said output signal is substantially equal in magnitude to said predetermined reference signal.

26. The apparatus of claim 25 wherein said first and second transistors first terminals are gate terminals, and further, wherein said first and second transistor second terminals are drain terminals.

27. The apparatus of claim 25 wherein said first transistor is a pMOS transistor.

28. The apparatus of claim 25 wherein said variable signal generator is a variable voltage generator.

29. The apparatus of claim 25 wherein said EPROM capacitor is a low leakage level capacitor.

30. The apparatus of claim 25 wherein said reference terminal is ground.

31. The apparatus of claim 25 wherein said first and second transistors are matched.

32. The apparatus of claim 25 further including:

a resistance coupled to said first transistor second terminal; and a variable resistance coupled to said second transistor second terminal configured to provide a resistance substantially equal to said resistance.

33. A method of providing a voltage reference, comprising the steps of:

providing a reference terminal;

providing an output terminal;

providing a first transistor having first and second terminals;

providing a second transistor having first and second terminals, said second transistor first terminal coupled to said output terminal and said second transistor second terminal coupled to said first transistor second terminal;

coupling an EPROM capacitor between said first transistor first terminal and said reference terminal and storing a predetermined reference signal; and coupling a variable signal generator to said second transistor first terminal to provide a variable signal and in accordance thereto providing an output signal to said output terminal;

wherein said variable signal is configured to vary such that said output signal is substantially equal in magnitude to said predetermined reference signal.

34. The method of claim 33 wherein said first and second transistors first terminals are gate terminals, and further, wherein said first and second transistor second terminals are drain terminals.

35. The method of claim 33 wherein said first transistor is a pMOS transistor.

36. The method of claim 33 wherein said variable signal generator is a variable voltage generator.

37. The method of claim 33 wherein said EPROM capacitor is a low leakage level capacitor.

38. The method of claim 33 wherein said reference terminal is ground.

39. The method of claim 33 wherein said first and second transistors are matched.

40. The method of claim 33 further including the steps of:

coupling a resistance to said first transistor second terminal; and coupling a variable resistance to said second transistor second terminal configured to provide a resistance substantially equal to said resistance.

* * * * *